United States Patent [19]

Gandrud et al.

[11] Patent Number: 5,018,587

[45] Date of Patent: May 28, 1991

[54] BRUSH ATTACHMENT

[75] Inventors: Dale E. Gandrud; Randall C. Nelson, both of Owatonna, Minn.

[73] Assignee: Gandy Company, Owatonna, Minn.

[21] Appl. No.: 477,584

[22] Filed: Feb. 8, 1990

[51] Int. Cl.[5] ..... A01B 45/00

[52] U.S. Cl. ..... 172/612; 172/684.5; 172/445.1; 172/776; 56/DIG. 12

[58] Field of Search ..... 15/78, 87; 56/DIG. 5, 56/DIG. 12; 111/132, 197, 901; 172/29, 445.1, 449, 612, 684.5, 776; 404/101

[56] References Cited

U.S. PATENT DOCUMENTS

| | | | |
|---|---|---|---|
| 417,477 | 12/1889 | Dundon | 15/78 X |
| 1,033,551 | 7/1912 | Davis | 172/142 |
| 1,544,662 | 7/1925 | Layton et al. | 15/78 |
| 1,546,071 | 7/1925 | Harris | 15/87 |
| 1,997,248 | 4/1935 | Densberger | 172/612 X |
| 2,186,658 | 1/1940 | Scheunemann | 172/776 X |
| 2,962,946 | 12/1960 | Neff | 404/101 |
| 3,878,901 | 4/1975 | Robertson, Sr. | 172/776 X |
| 4,140,187 | 2/1979 | Leclerc | 172/449 X |
| 4,312,095 | 1/1982 | Mullins | 56/400.14 |
| 4,747,174 | 5/1988 | Hightower | 15/78 |

FOREIGN PATENT DOCUMENTS

| | | | |
|---|---|---|---|
| 3636657 | 5/1988 | Fed. Rep. of Germany | 404/101 |

*Primary Examiner*—Dennis L. Taylor
*Assistant Examiner*—Jeffrey L. Thompson
*Attorney, Agent, or Firm*—John W. Bunch

[57] ABSTRACT

An improved brush attachment (10) includes a frame (12) comprising a semirigid plate (14) and rigid braces (16–24) so that the relative overall stiffness is adjustable in accordance with the contour of the underlying surface. An arrangement of end-to-end, oppositely angled brushes (46–60) is provided on the bottom of the frame (12).

15 Claims, 3 Drawing Sheets

BRUSH ATTACHMENT

TECHNICAL FIELD

The present invention relates generally to grounds maintenance equipment. More particularly, this invention concerns a brush attachment for grooming golf courses, athletic fields and alike.

BACKGROUND ART

The surfaces of golf courses and other outdoor playing fields require regular maintenance in order to maintain the desired smoothness. For example, the fairways and tees of a golf course must not only be mowed regularly, but the grass and turf must also be treated periodically to maintain healthy growth. Such maintenance usually involves first aerating the turf, spreading suitable top dressing and other turf building materials over the aerated turf, and then working the materials into the turf. Aeration is usually done with spike or plug-type machine which leave a fairly eved distribution of holes. However, the top dressing material is usually spread by hand or with some form of broadcast spreader, neither of which results in very even distribution. The best effect is not achieved unless these materials are spread evenly over the turf and then worked down into its surface and the aeration holes before watering. Because of its manually intensive nature, the spreading step has often been skipped or overlooked.

Various brush attachments have been available heretofore. For example, U.S. Pat. No. 4,747,174 to Hightower shows a grooming attachment for reconditioning the playing surface of a tennis court, which attachment utilizes a plurality of brushes arranged end-to-end transverse to the direction of travel. The brushes in the road cleaner and smoother shown in U.S. Pat. No. 1,033,551 to Davis are arranged side-by-side, but at an angle to the direction of travel. U.S. Pat. No. 2,962,946 to Neff shows a drag broom apparatus incorporating a leading transverse brush, an intermediate pair of brushes arranged in a v-shaped configuration, and a trailing transverse brush.

However, while a variety of brush attachments have been available heretofore, they have not been altogether satisfactory for spreading granular materials evenly over surfaces whose contours may not always be flat. For example, the brushes of the prior art generally tend to push the material forward with little or no lateral motion, which in turn can leave ridges. In addition, the brush attachments of the prior art tend to hop, which further affects the desired smoothing and leveling action. The brush attachments of the prior art have also tended to be of rigid construction with little or no flexibility to follow the surface contours. Heretofore, there has not been provided a brush attachment which is better adapted to follow the underlying surface while accomplishing better smoothing and leveling action.

SUMMARY OF THE INVENTION

The present invention comprises an improved brush attachment which overcomes the foregoing and other difficulties associated with the prior art. In accordance with the invention, there is provided a brush attachment which is particularly adapted for use with a utility vehicle, such as a lawn tractor or the like, for grooming golf courses, playing fields, parking lots and other outdoor surfaces. The brush attachment herein incorporates a semirigid frame whose degree of flexibility can be adjusted in accordance with the contour of the underlying surface in order to maintain optimal brush contact. A hitch is provided on the forward end of the frame. An arrangement of brushes is provided on the underside of the frame, in a unique configuration, in order to work the materials laterally as well as longitudinally as the attachment is being pulled by the tow vehicle.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
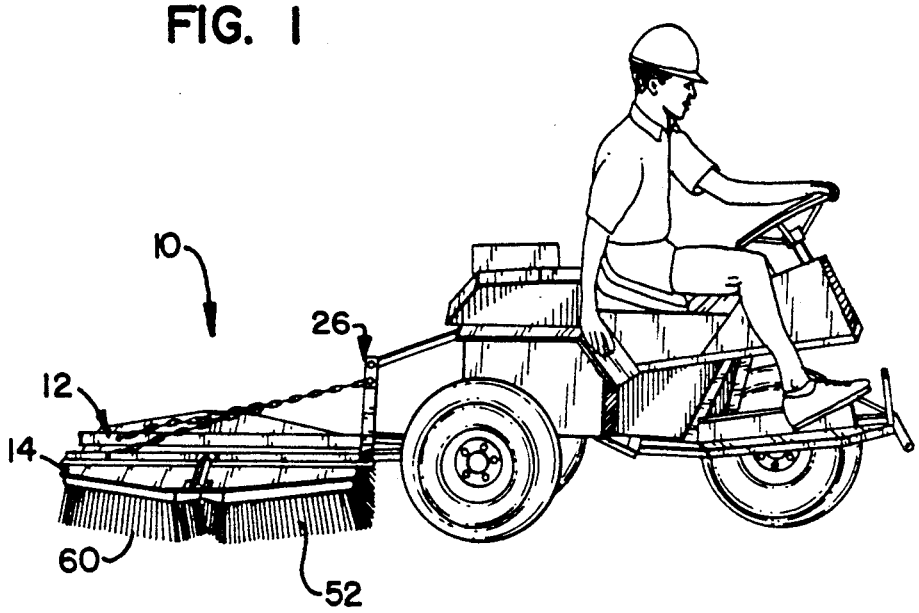
FIG. 1 is a perspective view of a brush attachment incorporating the invention, connected to a tow vehicle.

Referring now to the Drawings, wherein like reference numerals designate like or corresponding elements throughout the views, and particularly referring to FIG. 1 there is shown, the brush attachment 10 of the invention connected to a suitable tow vehicle, such as a garden tractor or utility vehicle. As will be explained more fully hereinafter, the brush attachment 10 of the invention incorporates an adjustable frame and unique brush arrangement to accomplish better working of top dressing and other granular materials into the surfaces of golf course greens, tees and fairways. Although the brush attachment herein particularly adapted for use on turf surfaces, it will be appreciated that the invention can also be used on parking lots, tennis courts, atheletic fields, and various other outdoor surfaces wherein better smoothing and leveling action is desired.

Figure 2:
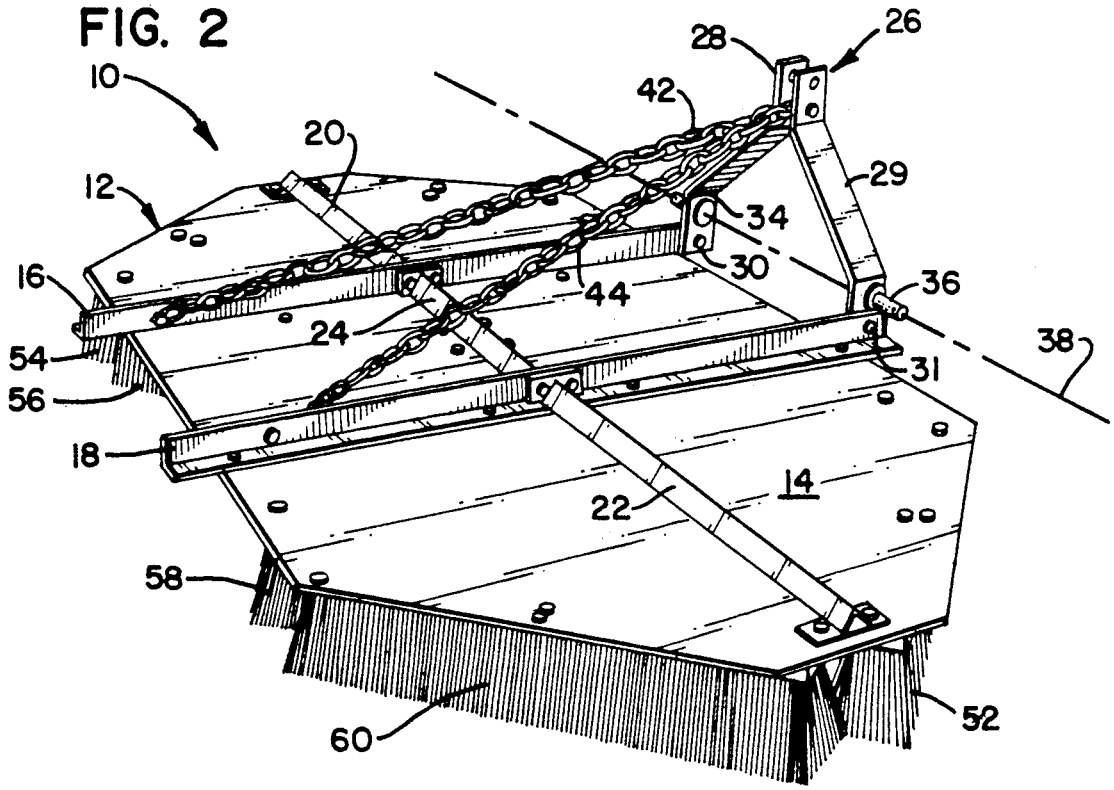
FIG. 2 is an enlarged perspective view of the brush attachment herein, with a 3- point hitch.
Figure 3:
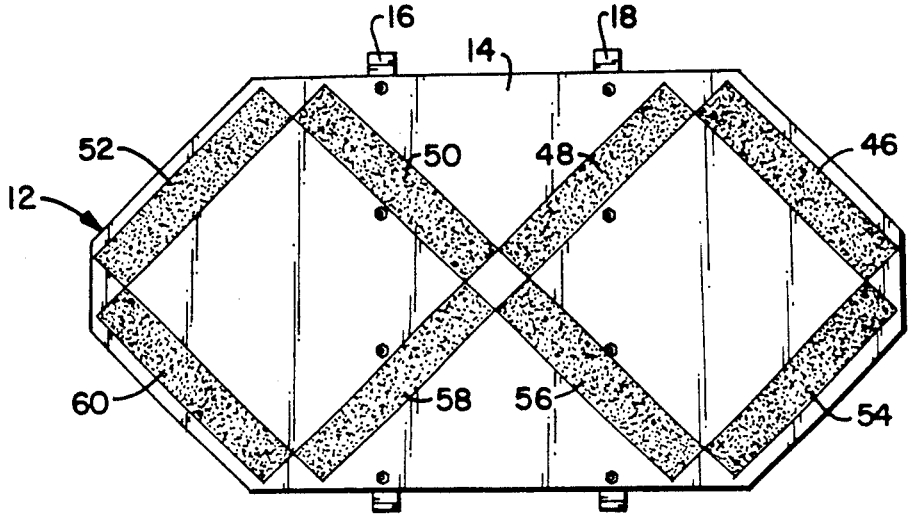
FIG. 3 is a bottom plan view of the brush attachment herein.

The constructional details of the brush attachment 10 are best seen in FIGS. 2 and 3. Brush attachment 10 includes a frame 12 whose relative stiffness or degree of flexibility is adjustable. In particular, frame 12 comprises a semirigid base plate 14 and rigid braces 16, 18, 20, 22 and 24. The base plate 14 is generally rectangular in shape, with chamfered corners as shown. In the preferred embodiment, the base plate 14 is formed from metal plate stock, such as 11 or 14 gauge steel. The braces 16, 18, 20, 22 and 24 are interconnected and secured to the top of plate 14. In the preferred embodiment, the braces 16–24 comprise lengths of angle iron. The braces 16 and 18 extend longitudinally in parallel, spaced-apart relationship. The braces 20, 22, and 24 are arranged laterally, in end-to-end relationship with the intermediate cross brace 24 positioned between the longitudinal braces 16 and 18. It will thus be appreciated that braces 16 and 18 are secured directly to plate 14, as are the outer ends of braces 20 and 22. The inner ends of braces 20 and 22 are secured directly to the longitudinal braces 16 and 18, as are both ends of the intermediate brace 24. In the preferred embodiment, nuts and bolts are utilized, although other suitable fasteners can be used. By varying the tightness of the fasteners interconnecting plate 14 and braces 16–24, the relative stiffness or flexibility of frame 12 can thereby be adjusted. This comprises an important feature of the present invention because it enables the brush attachment 10 to better follow the contour of the surface being brushed.

A 3-point hitch 26 is mounted on frame 12. In particular, hitch 26 comprises a pair of symmetrical lift arms 28 and 29 connected by pivots 30 and 31 at their lower ends to the forward ends of braces 16 and 18. The lift arms 28 and 29 include a pair of hitch pins 34 and 36, respectively, which define the fixed lower transverse pivot axis 38. A yoke pin (not shown) is provided in the upper end of the lift arms 28 and 29 to define the top connection point, as is well known. A pair of chains 42 and 44 are coupled between the lift arms 28 and 29 and the rear ends of braces 16 and 18, respectively, for lifting purposes.

Referring now particularly to FIG. 3, an arrangement of brushes is attached to the underside of the frame plate 14. The brushes are preferably arranged end-to-end, but at opposite angles in a double-diamond configuration as shown. The brush arrangement includes four leading brushes 46, 48, 50 and 52 followed by four trailing brushes 54, 56, 58 and 60. Each brush is set at an angle opposite to that of the adjacent brush. Brushes 46–60 preferably have synthetic fiber, mildew resistant bristles of suitable stiffiness for the surface being groomed. This also comprises an important feature of the present invention because such a brush configuration moves the surface material both laterally as well as longitudinally for better smoothing and leveling action. In addition, this brush configuration helps to minimize hopping as the attachment 10 is being towed.

Figure 4:
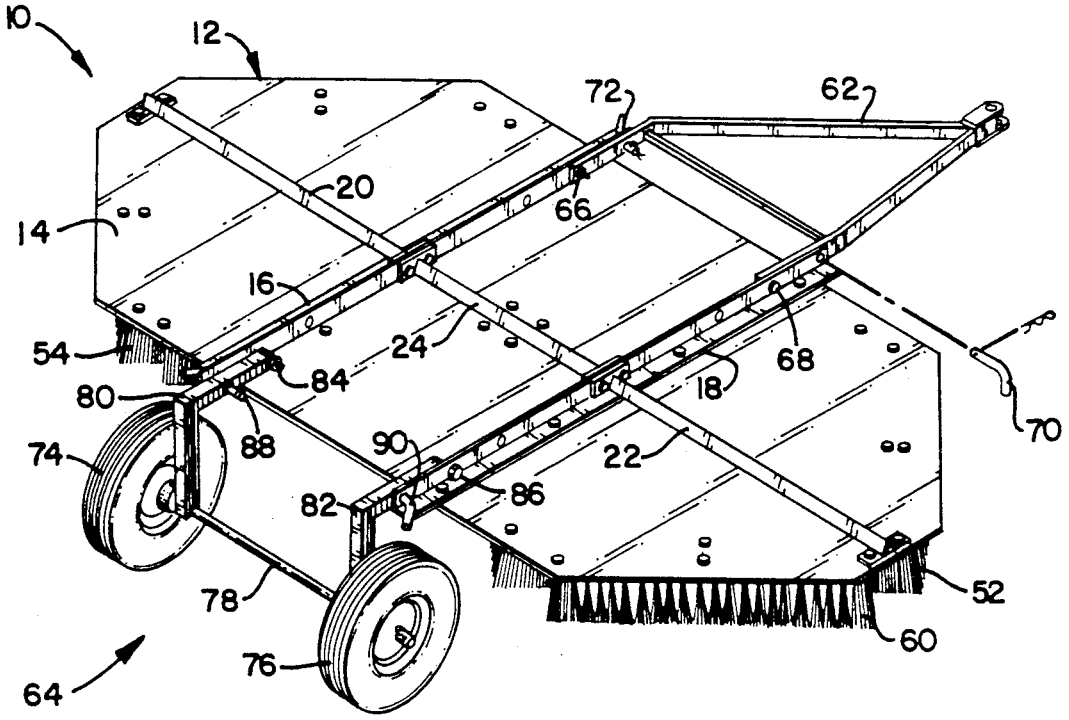
FIG. 4 is a perspective view of the brush attachment herein, but with a draw bar hitch and optional trailer wheels, which are shown in the down position.
Figure 5:
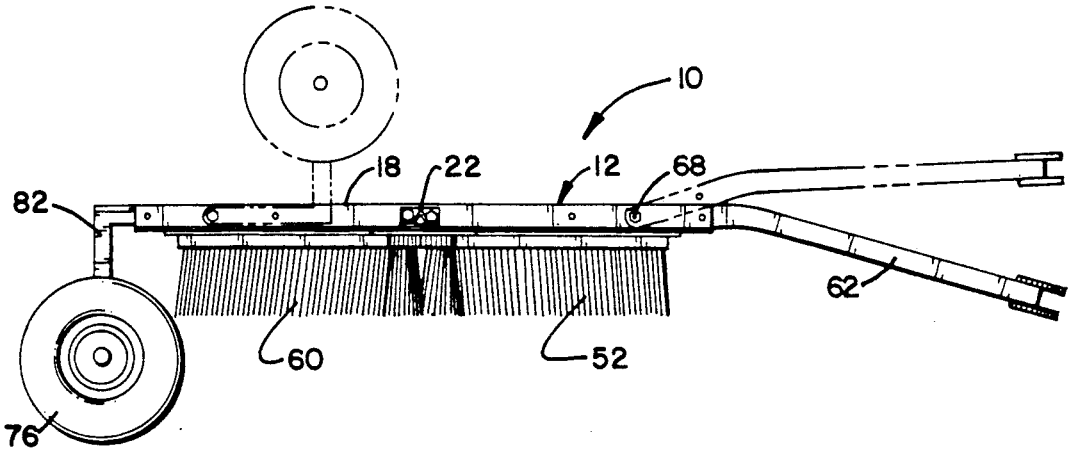
FIG. 5 is a side view thereof, showing the different pivotal positions of the draw bar hitch and trailer wheels.

FIGS. 4 and 5 show the brush attachment 10 with an optional draw bar hitch 62 and trailer 64. Instead of 3-point hitch like hitch 26, a draw bar hitch like hitch 62 can be connected to the forward ends of braces 16 and 18 by pivots 66 and 68. A pair of removable pins 70 and 72 and corresponding registering holes are also provided in the draw bar hitch and brace member 16 and 18 in order to lock the hitch against pivoting in the position shown in solid lines in FIG. 4. When the locking pins 70 and 72 are not in use, they can be inserted into other holes in the brace members 16 and 18 as shown. The trailer 64 is mounted at the opposite side of brush attachment 10. Trailer 64 includes a pair of wheels 74 and 76 mounted for rotation on opposite ends of an axle 78 carried between a pair of arms 80 and 82 connected by pivots 84 and 86 to brace members 16 and 18, respectively. The trailer 64 can be moved between a down position as shown in solid lines in FIGS. 4 and 5, or an up position as shown in phantom lines in FIG. 5. A pair of locking pins 88 and 90 and corresponding holes are provided in the brace members 16 and 18 for positively securing the trailer assembly 64 in either position as desired.

Other forms of custom hitches may also be used with brush attachment 10.

From the foregoing, it will thus be appreciated that the present invention comprises an improved brush attachment having several advantages over the prior art. One significant advantage is that the relative stiffness or flexibility of the frame can be adjusted in accordance with the underlying surface. Another advantage is the unique brush arrangement which effect better working of loose materials, both longitudinally as well as laterally, while minimizing the tendency to hop. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following Claims.

What is claimed:

1. A brush attachment for connection to a tow vehicle, comprising:

a semirigid plate having top and bottom sides;

a rigid frame;

means for adjustably interconnecting said frame and said plate in order to adjust the overall stiffness thereof;

hitch means mounted on said frame for selective attachment to the tow vehicle; and a plurality of elongate brushes secured in end-to-end relationship to the bottom side of said plate, said brushes being arranged in at least one row extending substantially across said plate, with each brush oriented at an angle opposite to that of the next adjacent brush.

2. The brush attachment of claim 1, wherein said plate comprises a substantially flat, metal plate.

3. The brush attachment of claim 1, wherein said means for adjustably interconnecting said frame and plate comprise nuts and bolts.

4. A brush attachment for connection to a tow vehicle, comprising:

a semirigid plate;

a rigid frame;

said frame including a plurality of longitudinal and lateral braces fastened to an upper side of said semirigid plate;

means for adjustably interconnecting said frame and plate in order to adjust the overall stiffness thereof;

hitch means mounted on said frame for selective attachment to the tow vehicle; and a plurality of brushes secured in end-to-end relationship to the side of said plate opposite said frame.

5. The brush attachment of claim 4, wherein said braces comprise lengths of angle iron.

6. A brush attachment for connection to a tow vehicle, comprising:

a semirigid plate;

a rigid frame;

means for adjustably interconnecting said frame and plate in order to adjust the overall stiffness thereof;

hitch means mounted on said frame for selective attachment to the tow vehicle;

said hitch means being a 3-point hitch; having two lower draft connections and an upper stabilizing connection and a plurality of brushes secured in end-to-end relationship to the side of said plate oppostite said frame.

7. A brush attachment for connection to a tow vehicle, comprising:

a semirigid plate;

a rigid frame;

means for adjustably interconnecting said frame and plate in order to adjust the overall stiffness thereof;

hitch means mounted on said frame for selective attachment to the tow vehicle;

said hitch means being a draw bar hitch; and a plurality of brushes secured in end-to-end relationship to the side of said plate opposite said frame.

8. The brush attachment of claim 7, further including:

means for securing one end of said hitch to said frame for limited pivotal movement about a transverse axis; and means for selectively securing said hitch against pivotal movement.

9. A brush attachment for connection to a tow vehicle, comprising:

a semirigid plate;

a rigid frame;

means for adjustably interconnecting said frame and plate in order to adjust the overall stiffness thereof;

hitch means mounted on said frame for selective attachment to the tow vehicle;

a plurality of brushes secured in end-to-end relationship to the side of the said plate opposite said frame;

a trailer assembly including a pair of wheels;

means for securing said trailer assembly to said frame opposite said hitch means for pivotal movement between raised and lowered positions; and means for selectively securing said trailer assembly in said raised and lowered positions.

10. A brush attachment for connection to a tow vehicle, comprising:

a semirigid plate having front and rear ends, and top and bottom sides;

rigid frame means including a plurality of longitudinal and lateral braces;

means for securing said frame means to the top side of said plate;

hitch means mounted on the top side of said plate at the front end thereof for selective attachment to the tow vehicle; and brush means secured to the bottom side of said plate, said brush means including a plurality of brushes arranged in end-to-end relationship with each brush oriented at an angle opposite to that of the next adjacent brush.

11. The brush attachment of claim 10, wherein said plate comprises a substantially flat, metal plate.

12. The brush attachment according to claim 11, wherein said braces comprise lengths of angle iron.

13. The brush attachment of claim 10, wherein said means for securing said frame and said plate comprise nuts and bolts which can be tightened in order to adjust the overall stiffness as desired.

14. The brush attachment of claim 10, wherein said hitch means comprises a draw bar hitch.

15. The brush attachment according to claim 14, further including:

means for securing one end of said hitch to said frame for limited pivotal movement about a transverse axis; and means for selectively securing said hitch against pivotal movement.

* * * * *